US008525506B2

(12) United States Patent
Nagatomo

(10) Patent No.: US 8,525,506 B2
(45) Date of Patent: Sep. 3, 2013

(54) SEMICONDUCTOR INTEGRATED CIRCUIT

(75) Inventor: Shigeru Nagatomo, Miyazaki (JP)

(73) Assignee: Lapis Semiconductor Co., Ltd., Tokyo (JP)

( * ) Notice: Subject to any disclaimer, the term of this patent is extended or adjusted under 35 U.S.C. 154(b) by 0 days.

(21) Appl. No.: 13/558,420

(22) Filed: Jul. 26, 2012

(65) Prior Publication Data

US 2013/0033251 A1 Feb. 7, 2013

(30) Foreign Application Priority Data

Aug. 4, 2011 (JP) ..... 2011-171046

(51) Int. Cl.
*G05F 3/16* (2006.01)

(52) U.S. Cl.
USPC ..... 323/313; 323/315; 323/901

(58) Field of Classification Search
USPC ..... 323/313, 314, 315, 316, 901; 327/142, 327/143, 538, 539
See application file for complete search history.

(56) References Cited

U.S. PATENT DOCUMENTS

| | | | | |
|---|---|---|---|---|
| 4,578,633 | A * | 3/1986 | Aoki | 323/315 |
| 4,999,567 | A * | 3/1991 | Morigami | 323/315 |
| 5,293,112 | A * | 3/1994 | Takahashi | 323/315 |
| 6,323,630 | B1 * | 11/2001 | Banba | 323/313 |
| 6,833,742 | B2 * | 12/2004 | Shimizu et al. | 327/143 |
| 6,882,134 | B2 * | 4/2005 | Balakrishnan et al. | 323/284 |
| 7,548,051 | B1 * | 6/2009 | Tenbroek et al. | 323/315 |
| 7,944,195 | B2 * | 5/2011 | Jang | 323/314 |
| 8,253,404 | B2 * | 8/2012 | Yoshii | 323/282 |

FOREIGN PATENT DOCUMENTS

JP 2009-140261 A 6/2009

* cited by examiner

*Primary Examiner* — Adolf Berhane
(74) *Attorney, Agent, or Firm* — Rabin & Berdo, P.C.

(57) ABSTRACT

A semiconductor integrated circuit includes constant current circuit, starter circuit and power supply start-up circuit. In the constant current circuit, first current mirror circuit includes first and second transistors, and second current mirror circuit includes third and fourth transistors that are connected to first and second nodes. In the starter circuit, a potential of first node controls sixth transistor, seventh transistor is connected to third node, gate electrode of the seventh transistor is at ground potential, a capacitance element is connected to fourth node, and a potential of fourth node controls fifth transistor, which supplies start-up current to the constant current circuit via second node. In the power supply start-up circuit, source electrode of eighth transistor is fixed at power supply voltage, gate electrode is at ground potential, and drain electrode supplies power to the other circuits.

5 Claims, 6 Drawing Sheets

SEMICONDUCTOR INTEGRATED CIRCUIT

CROSS-REFERENCE TO RELATED APPLICATIONS

This application is based on and claims priority under 35 USC 119 from Japanese Patent Application No. 2011-171046 filed on Aug. 4, 2011, the disclosure of which is incorporated by reference herein.

BACKGROUND

1. Technical Field

The present invention relates to a semiconductor integrated circuit, and relates to a semiconductor integrated circuit that starts up a constant current circuit.

2. Related Art

As an example of a semiconductor integrated circuit equipped with a circuit that starts up a constant current circuit, FIG. 5 illustrates a structure that is provided with a constant current circuit 112 and a starter circuit 114. The constant current circuit 112 is formed of a first current mirror circuit 101' that is configured with two first enhancement-mode transistors (p-channel MOS transistors) M1' and M2' and a second current mirror circuit 102' that is configured with two second enhancement-mode transistors (n-channel MOS transistors) M3' and M4'. The semiconductor integrated circuit illustrated in FIG. 5 addresses a problem that, if transistors with low threshold voltages Vt are used as the transistors configuring current mirror circuits, then if the rise of a power supply voltage is slow, start-up current may not be supplied to a constant current circuit and the constant current circuit may not start up.

That is, in the semiconductor integrated circuit illustrated in FIG. 5, a transistor M5' is turned on to the conducting state before an electrostatic capacitance element C1' is charged up with electric charge. Thus, the On current of transistor M5' is supplied to the constant current circuit 112 as start-up current and starts up the constant current circuit 112. After the start-up, a node N4' is charged up to the power supply voltage level, transistor M5' goes into the non-conducting state, and the constant current circuit 112 stabilizes at a predetermined operating point. A transistor with a high threshold voltage Vt is used as a transistor M7'. Therefore, if the rise of the power supply is slow, a rise in potential of node N4' due to leakage current if the temperature is high is prevented, the gate-source voltage (Vgs) of transistor M5' exceeds the threshold voltage Vt in this period, and the start-up current is supplied to the constant current circuit portion 112.

However, in the conventional semiconductor integrated circuit described above, if the rise of the power supply is slow, the capacitance element (capacitor) C1' of which one terminal is connected to node N4' is charged up by current in the sub-threshold region of transistor M7' (also referred to as the weak inversion region), that is, current that flows between the source and drain of transistor M7' even though the gate voltage is below the threshold voltage Vt. Therefore, for example, as illustrated by the broken line in FIG. 6, the potential of node N4' rises due to the charging, though at a different rate from the rise of the power supply voltage VDD. Between point A and point B in FIG. 6, the potential, which is VDD minus the potential of node N4' (i.e., VDD−$V_{N4}$), is the gate-source voltage Vgs of transistor M5'. Thus, there is a potential difference of $V_{N4}$ between the gate-source voltage Vgs of transistor M5' (which is denoted Vgs5) and the gate-source voltage Vgs of transistor M7 (which is denoted Vgs7).

The drain current in the weak inversion region of transistor M7' is known to have a characteristic that rises exponentially with respect to increases in the gate-source voltage Vgs. Therefore, the difference between Vgs7 of transistor M7' (=VDD) and Vgs5 of transistor M5' (=VDD-$V_{N4}$) is significant for the application of the constant current circuit start-up current. In the conventional constant current circuit described above, after the rise in VDD goes beyond point A in FIG. 6 (the point at which operation of the constant current circuit starts), the period of application of the start-up current lasts until node N4' is charged up to the potential VDD by drain current in the high inversion region above the threshold voltage Vt of transistor M7'. The supply of the start-up current is completed in this period. Thus, in the conventional constant current circuit described above, Vgs5 of transistor M5' depends on the potential of node N4'. Therefore, between point A and point B, it may not be clear whether or not Vgs5 of transistor M5' has reached a voltage Vgs relative to Vgs7 of transistor M7', which is sufficient to cause the start-up current of the constant current circuit to flow.

That is, in the conventional constant current circuit, if the rate of rise of the power supply voltage VDD is slow, the potential of node N4' rises due to a rise in the amount of charge on capacitor C1', and it is possible that the transistor M5' will turn off before the constant current circuit 112 starts up. Therefore, proposals for start-up circuit configurations that operate more stably are required.

SUMMARY

The present invention is proposed in consideration of the above circumstances, and provides a semiconductor integrated circuit that is capable of starting up a constant current circuit stably and reliably even if the rise of a power supply voltage is slow.

A first aspect of the present invention is a semiconductor integrated circuit including: a constant current circuit including: a first current mirror circuit that includes a first transistor and a second transistor, and a second current mirror circuit that includes a third transistor that is connected to a first node to which current flows from the first transistor, and a fourth transistor that is connected to a second node to which current flows from the second transistor; a starter circuit including: a sixth transistor, a control voltage of which is a potential of the first node, a seventh transistor that is connected to a third node to which current flows from the sixth transistor, a gate electrode of the seventh transistor being at a ground potential, a capacitance element that is connected to a fourth node to which current flows from the seventh transistor, and a fifth transistor, a control voltage of which is a potential of the fourth node, and that supplies start-up current to the constant current circuit via the second node; and a power supply start-up circuit including an eighth transistor, of which a source electrode is fixed at a power supply voltage and a gate electrode is at the ground potential, and that supplies power from a drain electrode to the constant current circuit and the starter circuit.

According to the present aspect, even if a rise of the power supply voltage is slow, a situation in which the starter circuit goes into a non-conducting state before the constant current circuit starts up may be avoided, and the constant current circuit may be started up more reliably than in the conventional art.

BRIEF DESCRIPTION OF THE DRAWINGS

Exemplary embodiments of the present invention will be described in detail based on the following figures, wherein.

DETAILED DESCRIPTION

Figure 1:
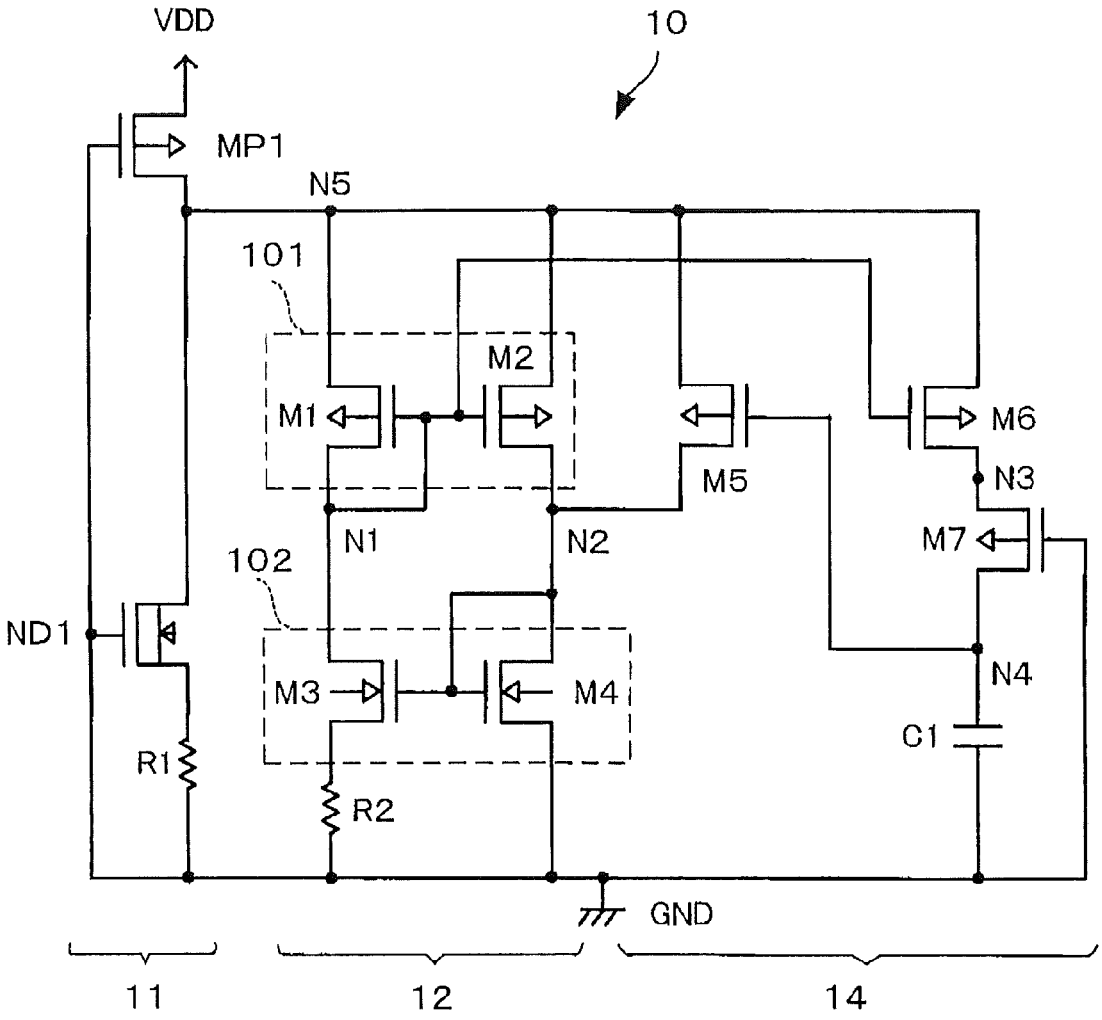
FIG. 1 is a circuit diagram illustrating the configuration of a semiconductor integrated circuit in accordance with an exemplary embodiment.

FIG. 1 is a circuit diagram illustrating the constitution of a semiconductor integrated circuit in accordance with an exemplary embodiment. As illustrated in FIG. 1, a semiconductor integrated circuit 10 according to the present exemplary embodiment is provided with a power supply start-up circuit 11, a constant current circuit 12 and a starter circuit 14. A power supply voltage VDD of, for example, 1 V (hereinafter referred to as a first voltage) and a ground voltage GND that is lower than the first voltage (hereinafter referred to where appropriate as a second voltage or as a source potential VSS) are provided to the semiconductor integrated circuit 10 by an unillustrated power supply.

In the power supply start-up circuit 11, the source terminal S of a p-channel MOS transistor MP1 is connected to the unillustrated power supply, and is at the power supply voltage VDD. The drain terminal D of transistor MP1 is connected to the drain terminal D of a depletion-mode transistor ND1. The source terminal S of the depletion-mode transistor ND1 is connected to ground through a resistor R1 (and thus is set to the source potential VSS). The gate terminal G of transistor MP1 and the gate terminal G of transistor ND1 are both grounded, being connected to the ground voltage GND.

The constant current circuit 12 includes a first current mirror circuit 101, a second current mirror circuit 102 and a resistor R2. The first current mirror circuit 101 is constituted by two first enhancement-mode transistors (for example, p-channel MOS transistors) M1 and M2. The p-channel MOS transistors M1 and M2 are each constituted by a gate terminal G (also referred to as a control terminal), a source terminal S (also referred to as a first terminal), and a drain terminal D (also referred to as a second terminal). The gate terminals G of transistor M1 and transistor M2 are connected to one another, and the gate terminal G and drain terminal D of transistor M1 are connected together (shorted). The drain terminal D of transistor M1 is connected to a first node N1, and the drain terminal D of transistor M2 is connected to a second node N2.

The first current mirror circuit 101 is in a non-conducting state when a voltage at a first voltage level is provided to the gate terminals G of transistor M1 and transistor M2 that are connected to one another, and is in a conducting state when a voltage at a second voltage level is provided to the same.

The second current mirror circuit 102 is configured by two second enhancement-mode transistors (for example, n-channel MOS transistors) M3 and M4. The n-channel MOS transistors M3 and M4 are each constituted by a gate terminal G (also referred to as a control terminal), a source terminal S (also referred to as a first terminal), and a drain terminal D (also referred to as a second terminal). The gate terminals G of transistor M3 and transistor M4 are connected to one another. The source terminal S of transistor M3 is connected to one terminal of the resistor R2, and the drain electrode D of transistor M3 is connected to the first node N1. The gate terminal G and drain terminal D of transistor M4 are connected together (shorted).

A second voltage, which is the ground voltage GND, is provided to the other terminal of the resistor R2. Current flowing at the first node N1 and the second node N2 are governed by the current gain of the second current mirror circuit 102, and are determined by the resistor R2. The second current mirror circuit 102 is in a conducting state when the voltage at the first voltage level is provided to the gate terminals G of the transistor M3 and transistor M4 that are connected to one another, and is in a non-conducting state when the voltage at the second voltage level is provided to the same.

The starter circuit 14 is configured by a p-channel MOS transistor M5, a p-channel MOS transistor M6, a p-channel MOS transistor M7 whose gate terminal G is set to the ground voltage GND, and a capacitance element (for example, a capacitor) C1. The drain terminal D of transistor M7 and one terminal of the capacitance element C1 are connected to a fourth node N4, and the ground voltage GND (the second voltage) is provided to the other terminal of the capacitance element C1. The threshold voltage Vt of transistor MP1 is specified as having an absolute value the same as that of transistor M7 or larger than that of transistor M7.

In the semiconductor integrated circuit 10 according to the present exemplary embodiment, a point of connection between the drain terminal D of transistor MP1 and the drain terminal D of transistor ND1 is connected to the respective source terminals S of transistor M1 and transistor M2 configuring the first current mirror circuit 101, and is connected to the respective source terminals S of transistor M5 and transistor M6 of the starter circuit 14. This point of connection between the power supply start-up circuit 11, the constant current circuit 12 and the start-up 14 is referred to as a fifth node N5. The power supply voltage is supplied to the constant current circuit 12 and the starter circuit 14 via node N5.

The drain terminal D of transistor M5 is connected to node N2. The gate terminal G of transistor M6 is connected to the gate terminals G of transistor M1 and transistor M2 configuring the first current mirror circuit 101 (and to node N1). Thus, transistor M1 and transistor M6 constitute a current mirror circuit. The source terminal S of transistor M6 is connected to the above-mentioned node N5, and the drain terminal D of transistor M6 is connected to a third node N3. The source terminal S of transistor M7 is connected to node N3, the drain terminal D of transistor M7 is connected to node N4, and the ground voltage GND is provided to the gate terminal G of transistor M7, as mentioned above. Transistors M5 and M6 are in the non-conducting state when the voltage at the first voltage level is provided to the gate terminals G as their control voltages, and are in the conducting state when the voltage at the second voltage level is provided to the gate terminals G as their control voltages.

Now, operation of the semiconductor integrated circuit of the present exemplary embodiment of the invention is described. When the power supply of the semiconductor integrated circuit 10 rises, if the rate of rise of the power supply is slow, current flows between the source terminal S and drain terminal D of the p-channel MOS transistor MP1 of the power supply start-up circuit 11 when the power supply voltage VDD rises and the voltage between the power supply voltage VDD and the ground voltage GND exceeds the threshold voltage Vt of transistor MP1. In the period before current flows between the source terminal S and drain terminal D of transistor MP1, node N5 is pulled down to the voltage level of the ground voltage GND by the grounded resistor R1, via the depletion-mode transistor ND1.

Figure 2:
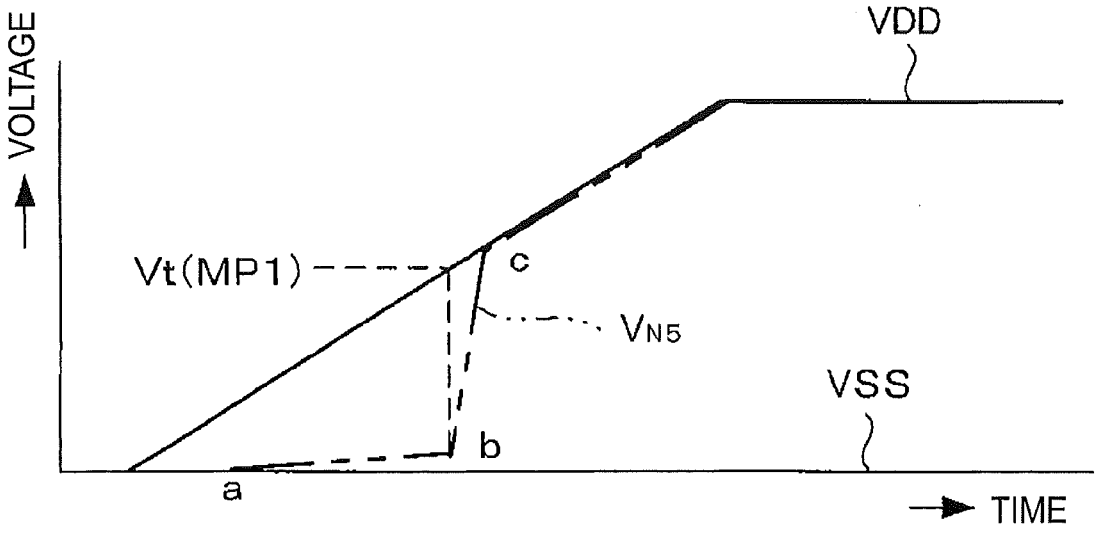
FIG. 2 is a diagram schematically illustrating voltage changes when a power supply of the semiconductor integrated circuit in accordance with the present exemplary embodiment rises.

FIG. 2 is a diagram schematically illustrating voltage changes when the power supply of the semiconductor integrated circuit according to the present exemplary embodiment rises. As illustrated in FIG. 2, when the power supply rises, the power supply voltage VDD starts to rise. Until the power supply voltage VDD reaches the threshold voltage Vt of transistor MP1, the potential level ($V_{N5}$) of node N5 is approximately at the voltage level (VSS) of the ground voltage GND, as indicated by line a-b in FIG. 2. This is because, if the rise of VDD is slow, current in the sub-threshold region of transistor MP1 (leakage current that flows between the source and the drain when the gate voltage of transistor MP1 is below the threshold voltage Vt) is released to the ground GND (the VSS) by the resistor R1, and node N5 is kept at the level of VSS.

When the power supply voltage VDD goes over the threshold voltage Vt of transistor MP1, transistor MP1 turns on and current flows between the source electrode S and drain electrode D of transistor MP1. Hence, the potential level of node N5 ($V_{N5}$) starts to rise rapidly due to the transistor MP1, as indicated by line b-c in FIG. 2, and rises to the level of VDD. Thereafter, the potential level of node N5 ($V_{N5}$) rises along with the power supply voltage VDD.

The node N5 serves as a power supply node for the constant current circuit 12 and start-up circuit 14 of the semiconductor integrated circuit 10. Thus, the constant current circuit 12 and starter circuit 14 perform start-up operations in response to the rise in the voltage level of node N5. As mentioned above, the threshold voltage Vt of transistor MP1 is specified as having an absolute value the same as that of transistor M7 or larger than that of transistor M7. Therefore, when the potential starts to be rapidly raised by transistor MP1, the transistor M7 quickly starts the start-up operation of the constant current circuit 12.

When the power supply rises, node N1 is at the potential level of node N5, that is, approximately the power supply voltage VDD (the first voltage level), and a voltage at the same potential as node N1 is provided to the gate terminal G of transistor M6. Therefore, transistor M6 is in the non-conducting state. Meanwhile, node N2 and node N4 are substantially at the voltage level of the ground voltage GND (the second voltage level). Thus, the voltage level of node N4, that is, a voltage level substantially at the ground voltage GND, is provided to the gate electrode G of transistor M5 as a control voltage.

Therefore, transistor M5 is in the conducting state, and current flows through transistor M5 to node N2. As a result, the voltage level of node N2 rises, and transistor M3 and transistor M4 of the second current mirror circuit 102 go into the conducting state. When transistors M3 and M4 are in the conducting state, current flows through node N1 and the voltage level of node N1 falls. When the voltage level at node N1 falls and the gate-source voltages (Vgs) of each of transistor M1 and transistor M2 go over their threshold voltages Vt, transistor M1 and transistor M2 go into the conducting state.

Therefore, current flows through transistor M1 to node N1, and current flows through transistor M2 to node N2. At this time, although transistor M6 is in the non-conducting state, the capacitance element C1 is charged up by current in the sub-threshold region of transistor M6 and the sub-threshold current flowing through transistor M7. As a result, the potential level of node N4 steadily rises.

Meanwhile, because of the fall in the voltage level of node N1, the voltage level that is applied to the gate electrode G of transistor M6 of the starter circuit 14 also falls. Thus, when the voltage level of node N1 falls and the gate-source voltage (Vgs) of transistor M6 goes over the threshold voltage Vt, transistor M6 goes into the conducting state. As a result, current flows through transistor M6 and transistor M7, which has been in the conducting state from the initial conditions, to node N4, and the charge accumulated at the capacitance element C1 is steadily increased by this current. When the charging of capacitance element C1 is complete, the potential level of node N4 is approximately at the power supply voltage VDD. Therefore, transistor M5 of the starter circuit 14 goes into the non-conducting state, and the supply of the start-up current to the constant current circuit 12 ends. Even when transistor M5 is in the non-conducting state, because current is already flowing to node N1 and node N2, the constant current circuit 12 subsequently operates stably.

The threshold voltages Vt of the transistors that configure the semiconductor integrated circuit 10 according to the present exemplary embodiment are specified such that, for example, transistors M7 and MP1 have higher threshold voltages Vt than transistors M1, M2, M5 and M6, and transistors M7 and MP1 have higher absolute values of Vt than transistors M3 and M4. If the transconductances gm of transistors M1, M2, M3 and M4 are represented by gm1, gm2, gm3 and gm4, respectively, current I1 flowing through node N1 and current I2 flowing through node N2 are as follows.

$$I1=k*T/q*\{\ln(gm1*gm2/gm3*gm4)\}$$

$$I2=gm2/gm1*I1$$

Here, k represents the Boltzmann constant, T represents the absolute temperature, q represents the elementary charge, and * represents the multiplication sign.

In the semiconductor integrated circuit 10 according to the present exemplary embodiment, the source electrode S of the depletion-mode transistor ND1 is connected to ground (potential VSS) via the resistor R1, and the gate electrode G of the depletion-mode transistor ND1 is fixed at the potential VSS. Therefore, during usual operations of the constant current circuit 12, constant source-drain current flows in the depletion-mode transistor ND1, and this current flows through the resistor R1. Therefore, current consumption of the power supply start-up circuit 11 is constant regardless of the power supply voltage VDD.

As described above, the semiconductor integrated circuit according to the present exemplary embodiment has a configuration in which the source electrode S of a p-channel MOS transistor is connected to the power supply voltage VDD, the gate electrode G is at the ground potential, and the drain electrode D is connected to power supply terminals of the constant current circuit and the start-up circuit. Thus, when the power supply rises and the power supply voltage VDD goes over the threshold voltage Vt of the p-channel MOS transistor, the transistor turns on and current flows between the source electrode S and the drain electrode D. The potential level of the node at the point of mutual connection between the drain electrode D and the constant charge circuit and starter circuit starts to rapidly rise, and rises to the level of VDD. Therefore, a non-starting state that is caused by sub-threshold current to the capacitance in the starter circuit may be eliminated, and cases of the start-up transistor turning off before the start-up of the constant current circuit may be avoided.

Moreover, the power supply start-up circuit is provided, in which the source electrode S of the p-channel MOS transistor is connected to the power supply (voltage VDD), and the drain electrode D is connected to the drain electrode D of a depletion-mode transistor. The source electrode S of the depletion-mode transistor is set to the potential VSS, via the resistor R1, and the gate electrodes G of both the p-channel MOS transistor and the depletion-mode transistor are set to the potential VSS. The point of mutual connection between the drain electrode D of the p-channel MOS transistor and the drain electrode D of the depletion-mode transistor ND1 serves as a power supply node of the constant current circuit and the starter circuit, and supplies an operating power supply to the constant current circuit and the starter circuit.

With this configuration, if the rise of the power supply is slow, current in the sub-threshold region of the p-channel MOS transistor is released to the VSS side by the resistor R1, and the node that is the aforementioned point of mutual connection is kept at the level of VSS. When the power supply voltage VDD goes above the threshold voltage Vt of the p-channel MOS transistor, this transistor turns on and current flows between the source electrode S and the drain electrode D. The potential level of the node at the point of mutual connection starts to rapidly rise, and rises to the level of VDD. Consequently, a non-starting state due to sub-threshold current to the capacitance in the start-up circuit may be eliminated—that is, the accumulation of unnecessary charge at the capacitance may be suppressed—and cases of the start-up transistor turning off before the start-up of the constant current circuit may be avoided.

Furthermore, with the configuration in which the depletion-mode transistor ND1 is disposed at the power supply start-up circuit, during usual operation of the constant current circuit, constant source-drain current flows in the depletion-mode transistor and this current flows through the resistor R1. Thus, current consumption of the power supply start-up circuit is constant regardless of the power supply voltage VDD. Therefore, a voltage applied to resistor R1 may be reduced. The current consumption value is determined by the resistor value in relation with the threshold voltage Vt of the depletion-mode transistor. Therefore, if the current should be set to be small, the resistor value may be made smaller, and a surface area of the resistor R1 in the semiconductor integrated circuit may be reduced.

In the semiconductor integrated circuit according to the exemplary embodiment described above, the p-channel MOS transistor M7 is disposed in the starter circuit, and the transistor M7 operates in response to a rise at node N5. Therefore, even if the start-up of the power supply voltage VDD is fast, a start-up duration may be assured, and the capacitance of the capacitance element C1 may be made small. In the case of a configuration in which the transistor M7 is removed from the starter circuit, if a rise in the power supply is fast, nodes N4 and N5 rise at the same time and the start-up duration may not be attained. To avoid this, it is necessary to make the capacitance of the capacitance element C1 larger. However, in this configuration, the number of components in the semiconductor integrated circuit 10 may be reduced.

Figure 3:
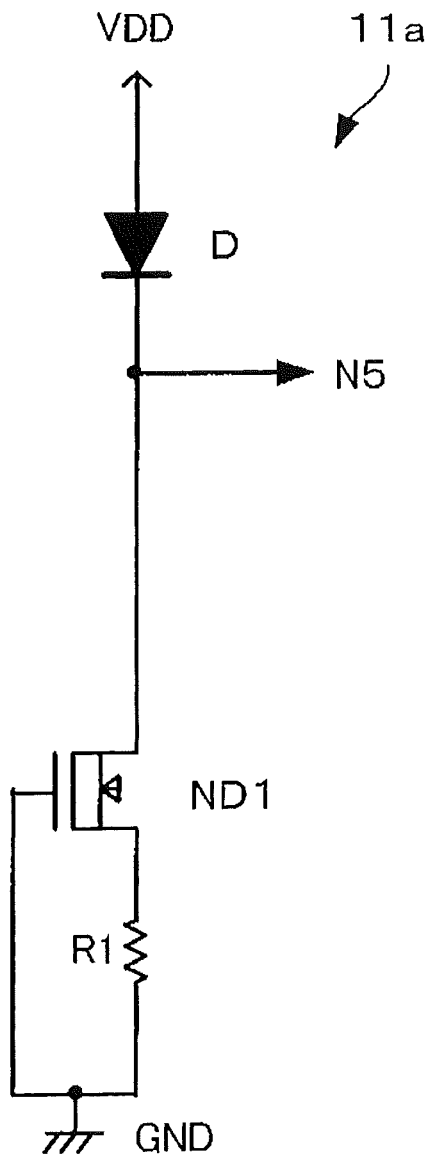
FIG. 3 is a diagram illustrating a variant example of the semiconductor integrated circuit of the present exemplary embodiment.

The semiconductor integrated circuit according to the exemplary embodiment has been described in which the p-channel MOS transistor is disposed in the power supply start-up circuit and the drain electrodes of the p-channel MOS transistor and the depletion-mode transistor are connected together, but embodiments are not limited to this. For example, as illustrated in FIG. 3, a configuration is possible in which a diode element D is provided instead of the p-channel MOS transistor.

Figure 4:
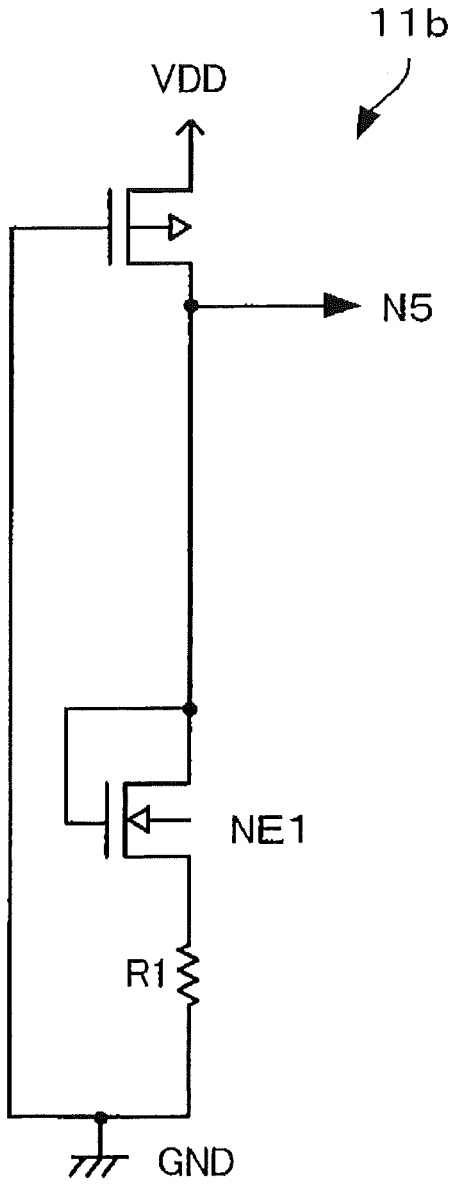
FIG. 4 is a diagram illustrating another variant example of the semiconductor integrated circuit of the present exemplary embodiment.
Figure 5:
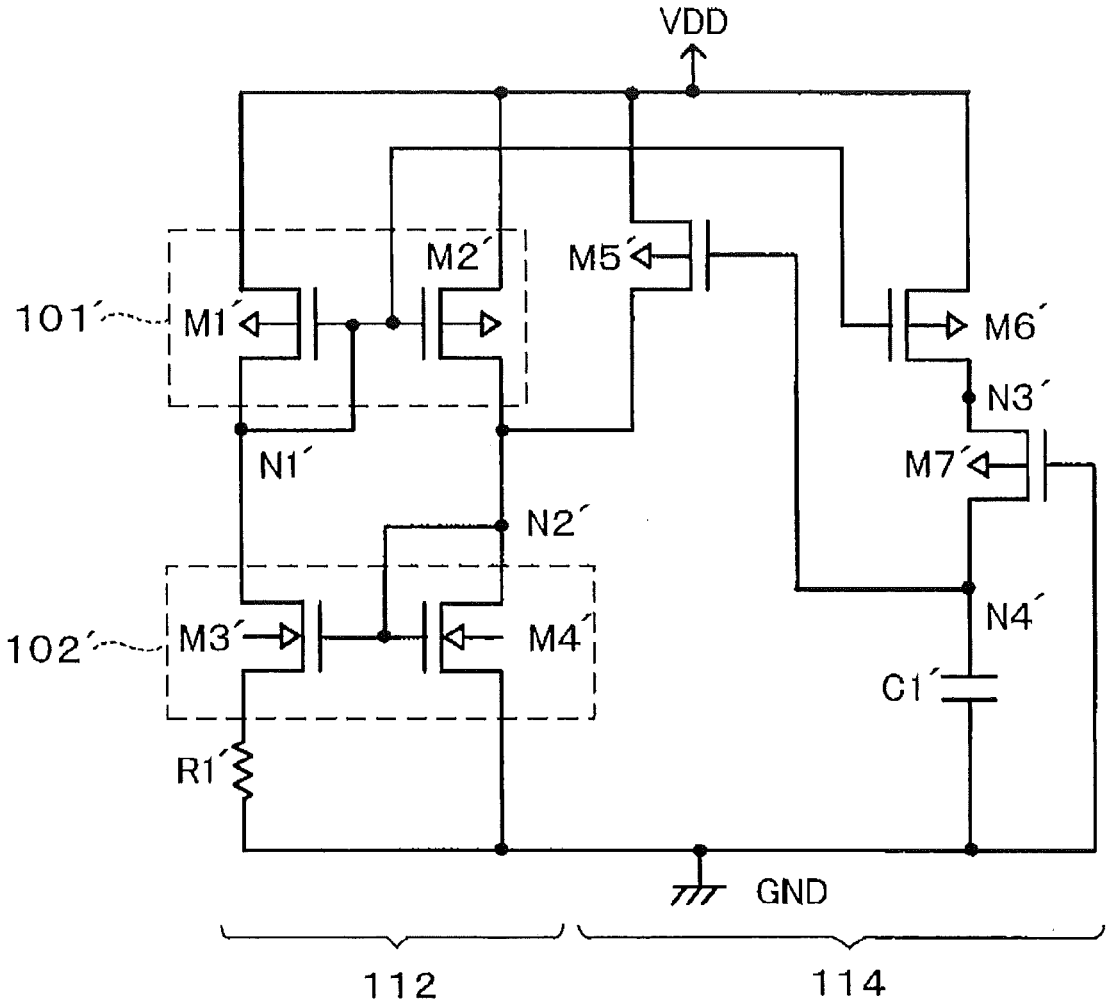
FIG.5 PRIOR ART
FIG. 5 is a circuit diagram illustrating the constitution of a conventional semiconductor integrated circuit.
Figure 6:
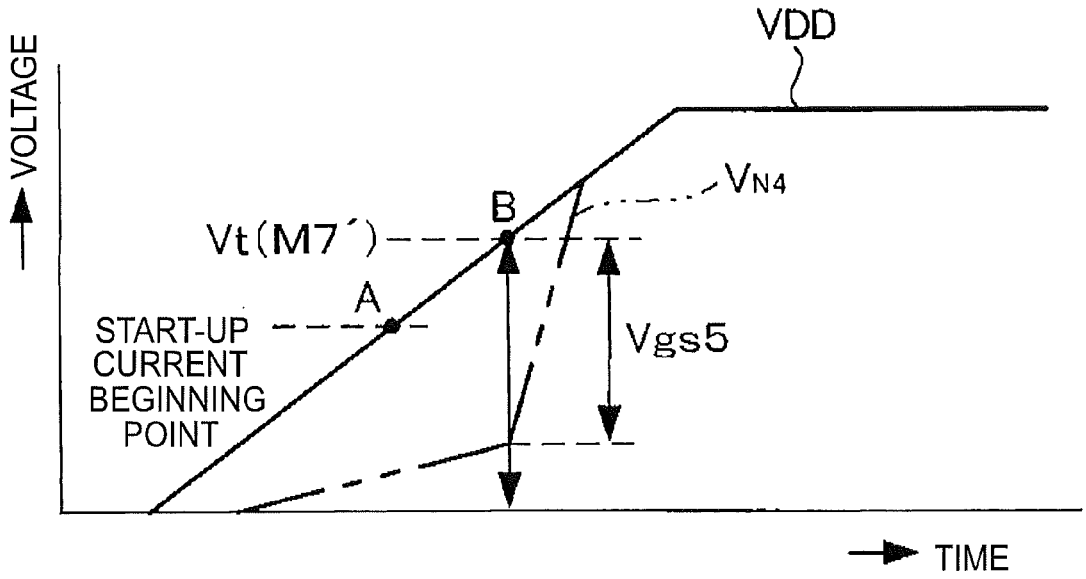
FIG.6 PRIOR ART
FIG. 6 is a diagram schematically illustrating voltage changes when a power supply of the conventional semiconductor integrated circuit rises.

The semiconductor integrated circuit according to the exemplary embodiment has been described to have a configuration in which a depletion-mode transistor is connected to the drain electrode D of the p-channel MOS transistor. However, embodiments are not limited to this and, as illustrated in FIG. 4, a diode-connected enhancement-mode n-type transistor NE1 may be provided instead of the depletion mode transistor.

What is claimed is:

1. A semiconductor integrated circuit comprising:

a constant current circuit including:

a first current mirror circuit that includes a first transistor and a second transistor, and a second current mirror circuit that includes a third transistor that is connected to a first node to which current flows from the first transistor, and a fourth transistor that is connected to a second node to which current flows from the second transistor;

a starter circuit including:

a sixth transistor that uses a potential of the first node as a control voltage, a seventh transistor that is connected to a third node to which current flows from the sixth transistor, a gate electrode of the seventh transistor being at a ground potential, a capacitance element that is connected to a fourth node to which current flows from the seventh transistor, and a fifth transistor that uses a potential of the fourth node as a control voltage, and that supplies start-up current to the constant current circuit via the second node; and a power supply start-up circuit including an eighth transistor, of which a source electrode is fixed at a power supply voltage and a gate electrode is at the ground potential, and that supplies power from a drain electrode to the constant current circuit and the starter circuit.

2. The semiconductor integrated circuit according to claim 1, further comprising a voltage reduction portion that reduces a potential of the drain electrode of the eighth transistor toward the ground potential when the eighth transistor is non-conducting.

3. The semiconductor integrated circuit according to claim 2, wherein the voltage reduction portion comprises a resistor, of which one end is connected to the drain electrode of the eighth transistor and the other end is at the ground potential.

4. The semiconductor integrated circuit according to claim 2, wherein the voltage reduction portion comprises:

a resistor, an end of which is at the ground potential; and a ninth transistor of which a drain electrode is connected to the drain electrode of the eighth transistor, a gate electrode is at the ground potential, and a source electrode is connected to another end of the resistor.

5. The semiconductor integrated circuit according to claim 4, wherein the ninth transistor is a depletion-mode transistor.

* * * * *